United States Patent [19]

Waryasz

[11] 4,173,950

[45] Nov. 13, 1979

[54] COAL FIRED FLUID BED MODULE FOR A SINGLE ELEVATION STYLE FLUID BED POWER PLANT

[75] Inventor: Richard E. Waryasz, Chicopee, Mass.

[73] Assignee: Combustion Engineering, Inc., Windsor, Conn.

[21] Appl. No.: 921,927

[22] Filed: Jul. 3, 1978

[51] Int. Cl.[2] ..... F22B 1/02; F23D 19/02

[52] U.S. Cl. ..... 122/4 D; 110/263

[58] Field of Search ..... 110/245, 263; 165/104 F; 122/4 D

[56] References Cited

U.S. PATENT DOCUMENTS

| | | | |
|---|---|---|---|
| 3,387,590 | 6/1968 | Bishop | 122/4 |
| 3,893,426 | 7/1975 | Bryers et al. | 122/4 |

FOREIGN PATENT DOCUMENTS

| | | | |
|---|---|---|---|
| 858813 | 1/1961 | United Kingdom | 122/4 |

*Primary Examiner*—Kenneth W. Sprague
*Attorney, Agent, or Firm*—Wayne H. Lang

[57] ABSTRACT

A fluidized bed for the burning of pulverized fuel having a specific waterwall arrangement that comprises a structurally reinforced framework of wall tubes. The wall tubes are reversely bent from opposite sides and then bonded together to form tie rods that extend across the bed to support the lateral walls thereof.

12 Claims, 3 Drawing Figures

COAL FIRED FLUID BED MODULE FOR A SINGLE ELEVATION STYLE FLUID BED POWER PLANT

BACKGROUND OF THE INVENTION

Combustion of coal in electric power plants contributes greatly to the sulphur and nitrogen oxide compounds being emitted into the environment today. As a result, there have been various attempts to reduce the emission of such pollutants from exhaust stacks that discharge the pollutants from all types of power plants fired with a variety of fossil fuels.

One approach has been to clean the exhaust gases through the use of cyclone type collectors, electrostatic precipitators, scrubbers, and catalytic converters. While the use of this type apparatus may be made to perform an effective job, the process involved may be complicated and expensive.

The present invention provides a potential method of utilizing coal for electric power generation in an environmentally accepted manner by virtue of the reduction of sulphur and nitrous oxide emissions in the fluid bed combustion process.

SUMMARY OF THE INVENTION

The present invention therefore relates to an arrangement for a fluid bed type reactor in which a series of fluid bed modules in lateral juxtaposition are supported on a single level. These fluid beds are enclosed by horizontal waterwalls and heat is removed therefrom by a tube bundle that contains a coolant circulated therethrough. The fluid beds are fed coal and limestone through feed nozzles on the lower side thereof while air for combustion is supplied through a grid plate at the bottom of the unit. The products of combustion from these beds are funneled into a common convection pass.

BRIEF DESCRIPTION OF THE DRAWINGS

The invention will be more clearly understood from the following description read in conjunction with the accompanying drawings in which.

DESCRIPTION OF THE PREFERRED EMBODIMENT

The apparatus includes a series of laterally juxtaposed modules 20 which are enclosed by a standard arrangement of horizontal waterwalls that enclose a combustion chamber, while heat is removed therefrom by a tube bundle inserted into the combustion chamber through an end wall of each module. Each module is constructed to a height that is required to prevent the exchange of the fluidized bed material between one module and another adjacent thereto.

An end wall of each unit 20 is constructed to provide an end tube wall 1 of laterally spaced tubes between which the tube bundle 2 of spaced tubes may itself be inserted into the unit to extract heat therefrom.

Figure 1:
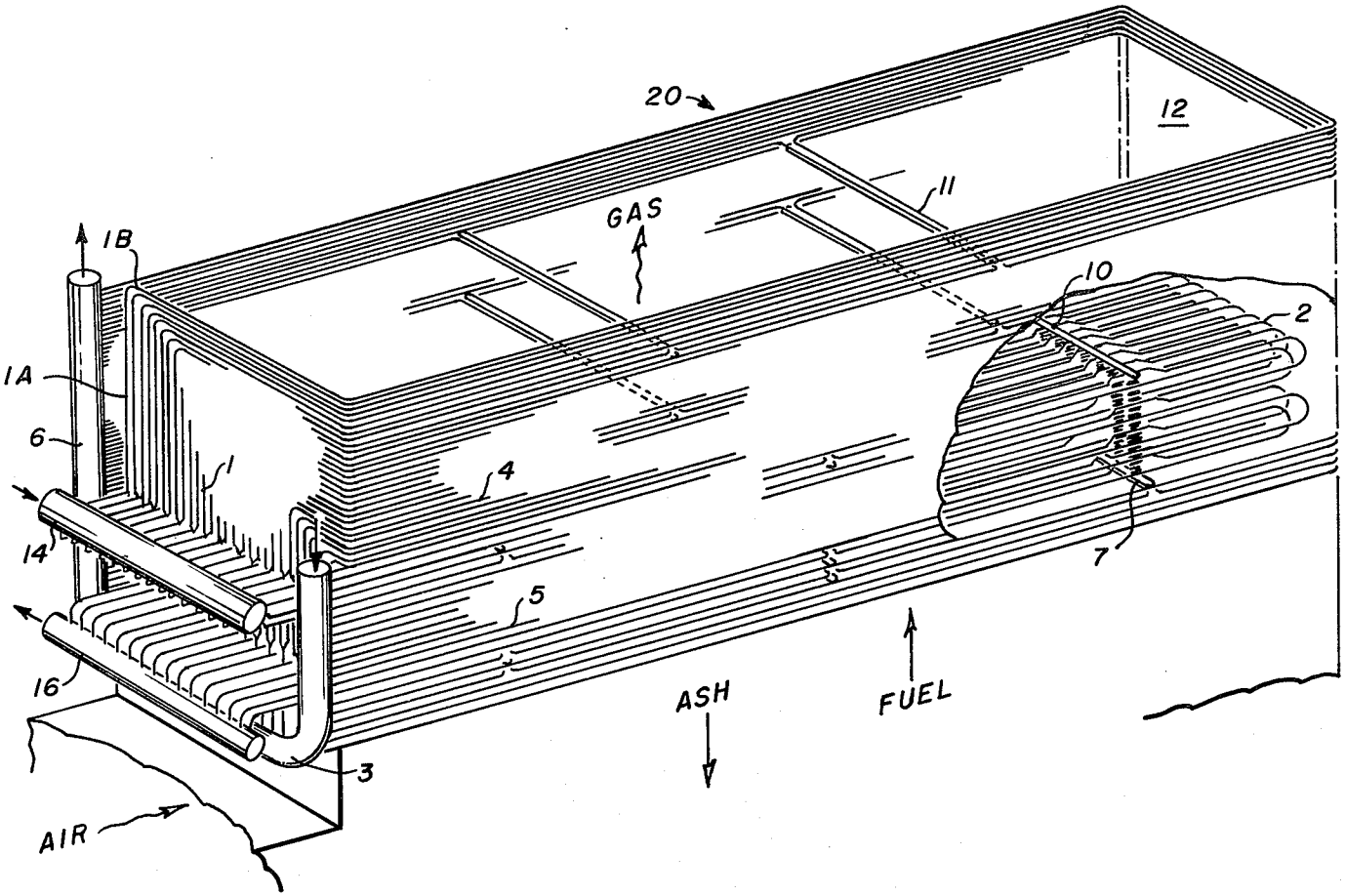
FIG. 1 is a perspective view of a fluid bed module constructed in accordance with the present invention.
Figure 2:
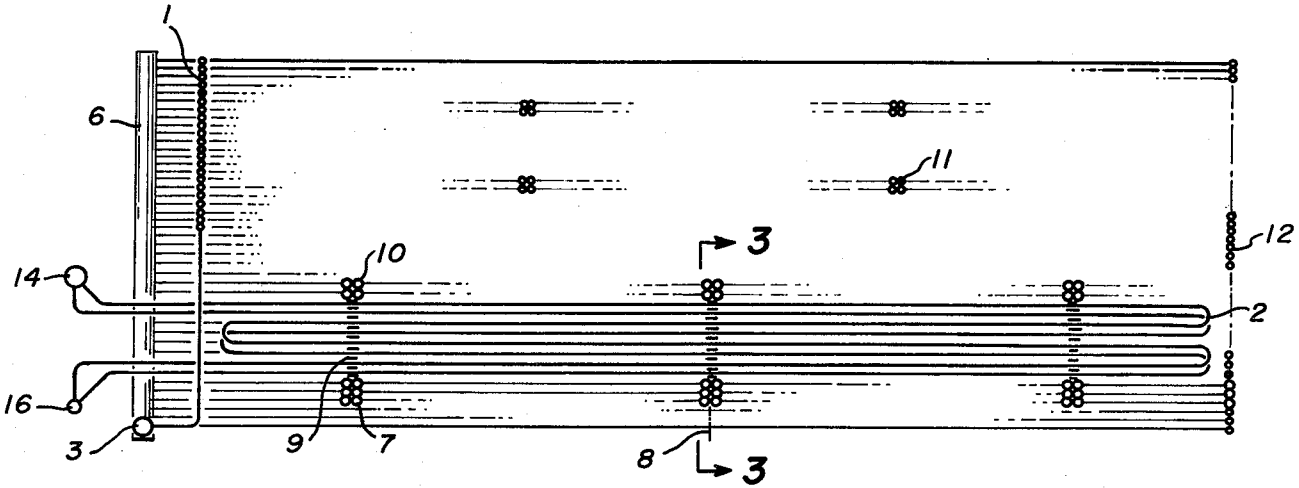
FIG. 2 is a cross-section of a fluid bed module.

The end wall 1 is formed by using an "L" shaped waterwall header 3 that is adapted to extend horizontally across the bottom and vertically along a partial side of each unit as shown in FIG. 1. Some water tubes 1A, 1B, etc., from the horizontal section of header 3 extend vertically while other tubes 5 extend horizontally from the vertical section of header 3. The tube at the extreme left of waterwall 1 extends vertically a distance that is calculated to reach the full height of the unit. This tube is then bent 90° to a horizontal plane such that it becomes the top tube of the end vertical wall. The water tube is then bent 90° so that it becomes the top horizontal tube of upper wrapper tubes 4 that constitute a wide wall of each module. This tube then extends horizontally before it is imparted another 90° bend to a horizontal plane to form rear wall 12 where it lies parallel to the top tube of end wall 1. Tube 1A of wall 12 is then again bent horizontally 90° to form the top tube of side wall that lies parallel to wrapper tubes 4 and 5. The tube continues to extend horizontally until it terminates in outlet header 6.

A second tube 1B extends vertically from a spaced position in horizontal header 3 and is bent horizontally just under the first horizontal run of tube 1A. Tube 1B is then bent 90° to form the side wall that lies just under tube 1A of the upper wrapper tubes. Subsequent 90° bends then make horizontal runs that form the end wall and the side walls before also terminating in header 6. Additional vertical tubes from end wall 1 extend from header 3 and are also bent horizontally under tubes 1A and 1B. Horizontal runs from the vertical portion of header 3 then form the lower wrapper tubes 5 which, after several 90° bends, are connected back to outlet header 6. The vertical runs of all tubes 1 that comprise end wall 1 are spaced apart to permit entry between such tubes of the individual tubes of a tube bundle 2 which is adapted to extract heat from within the module.

The tube bundle 2 is supported within the unit by one or more tube support beams 7 located at each support point 8. The support beams 7 are positioned at the lower portion of the unit and they comprise waterwall tubing that extends between side walls of the unit formed by the lower wrapper tubes 5. The tubes of support beam 7 are continuations of wrapper tubes 5 that extend horizontally from one wall to the opposite wall and are looped back to lie adjacent the first horizontal run of the tube. Each tube then continues to extend around the unit similar to the other tubes of the waterwall before being connected back into outlet header 6. The next subjacent waterwall tube also includes one or more looped sections that originate in the side wall opposite that of the first tube, while a subjacent tube is looped similar to the top tube of the composite support beam 7. After aligning adjacent loops of tubing they are welded together to form a beam that is anchored in the side walls so they rigidly support the tube bundle and, along with similarly looped wall tubes 10 and 11, they provide beams that support the side walls to act as a buckstay system that adds rigidity thereto.

The tubes that comprise the support beam 7 are preferably made of tubing having a larger diameter than the standard waterwall tubing whereby the resistance effect of the repeated bends will not be a significant factor in reducing the flow therethrough.

The guide beams 10 are vertically spaced from support beams 7 such that there is provided therebetween a space for the tube bundle 2 that is inserted through end wall 1.

Figure 3:
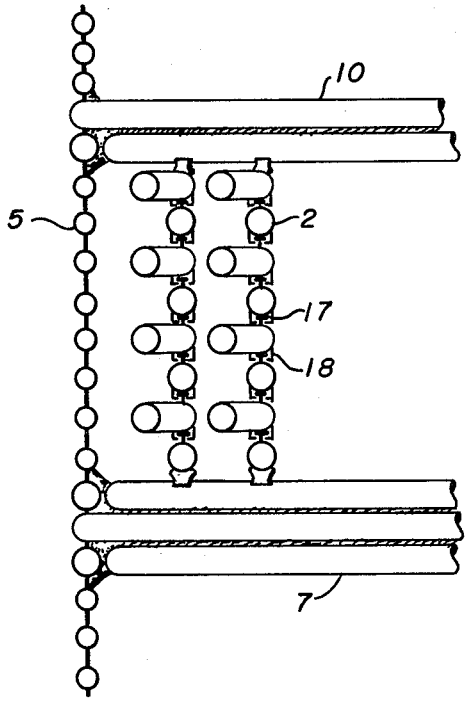
FIG. 3 is a cross-section of a fluid bed module as seen from line 3—3 of FIG. 2.

The tube bundle 2 of looped tubing which is connected to an inlet header 14 and outlet header 16 extracts heat from within the module and then directs it to a suitable place of use (not shown). Vertically adjacent runs of tubing in each bundle 2 are loosely connected to one another by a series of movable flex-ties that are welded to adjoining tubes in the manner shown by FIG. 3. These flex-ties comprise essentially a rail 16 welded to the upper portion of each tube in the tube bundle 2 that is adapted to freely slide in a hanger 18 that is welded to the bottom of each adjacent tube. The upper and lower tubes of each bundle are firmly connected to the guide beam 10 and to the support beam 7 to anchor each tube bundle 2 in the fluidized bed.

In operation, particulate fuel and ground limestone are slowly fed to the bottom of each unit where they are supplied with combustion air and burned in the fluidized bed in accordance with standard operating procedure. Hot exhaust gases from the combustion of particulate fuel within each unit are directed upward over tube bundle 2 and out the top of each unit, where they are combined with exhaust gases from other units and vented to the atmosphere. Ash resulting from the combustion process being carried out within each fluidized bed is drawn off from the bottom of each unit and disposed of in a conventional manner.

The apparatus of this invention may be utilized in a process for the gasification of coal or, after obvious modifications of spacing and size, for other applications where a shop assembled unit is to be preferred.

I claim:

1. A fluidized bed for the combustion of particulate fuel comprised of waterwall tubing having inlet and outlet ends thereof arranged to form a rectangular enclosure that surrounds a combustion chamber and has open areas at the bottom and top thereof for the inlet and outlet of fuel and air, a source of cooling fluid, an outlet header connected to the oulet ends of said waterwall tubing and arranged to receive the cooling fluid after it has circulated therethrough, and an "L" shaped inlet header adjacent the periphery of said fluidized bed adapted to supply cooling fluid from said source of cooling fluid to the inlet ends of said waterwall tubes for circulation to the outlet header.

2. A fluidized bed as defined in claim 1 wherein the horizontal section of said "L" shaped header has vertical outlet tubes connected thereto to supply cooling fluid to the adjacent end of said waterwall.

3. A fluidized bed as defined in claim 2 wherein the vertical section of said "L" shaped inlet header has a plurality of outlet ports that supply cooling fluid to the lower portion of the waterwall tubes forming said enclosure.

4. A fluidized bed as defined in claim 3 wherein waterwall tubes that extend vertically from the horizontal section from the "L" shaped header are bent horizontally to lie vertically adjacent one another and to extend around the enclosure to supply cooling fluid to that portion of the waterwall that lies above the waterwall tubes connected to the vertical section of the "L" shaped header.

5. A fluidized bed as defined in claim 4 including inlet and outlet headers with an elongate tube bundle therebetween arranged to be inserted into said enclosure between the tubes that extend vertically from the horizontal section of the "L" shaped header.

6. A fluidized bed as defined in claim 5 including a support beam extending across said enclosure of waterwalls adapted to support the elongate tube bundle therein.

7. A fluidized bed as defined in claim 6 wherein the support beam comprises tubes of said waterwall having a reverse loop therein adapted to extend across said enclosure.

8. A fluidized bed type reactor as defined in claim 7 wherein said support beam that supports the elongate tube bundle is comprised of looped sections of waterwall tubing that extend from opposite sides of the enclosure, and bonding means connecting the looped sections of waterwall to comprise a rigid beam that is connected to opposite walls of said enclosure.

9. A fluidized bed type reactor as defined in claim 8 wherein the waterwall tubing that comprises the support beam extending across the enclosure has greater internal diameter than the sections of waterwall tubing lying adjacent thereto.

10. A fluidized bed type reactor as defined in claim 9 including a guide beam comprised of looped waterwall tubing spaced above said support beam to provide a spacing for the tube bundle therebetween.

11. A fluidized bed type reactor as defined in claim 10 including vertically disposed hangers extending between the support beams and the guide beams to support the elongate tubes of the tube bundle therebetween.

12. A fluidized bed type reactor as defined in claim 11 wherein the vertically disposed hangers are comprised of a multiplicity of independent sections linked together to permit relative movement therebetween.

* * * * *

UNITED STATES PATENT OFFICE

CERTIFICATE OF CORRECTION

Patent No. 4,173,950 Dated November 13, 1979

Inventor(s) Richard E. Waryasz

It is certified that error appears in the above-identified patent and that said Letters Patent are hereby corrected as shown below:

Column 1, line 6, insert as the first paragraph following "BACKGROUND OF THE INVENTION" --The government of the United States of America has rights in this invention pursuant to contract No. EX-76-C-01-2473 awarded by the U.S. Energy Research and Development Administration.--.

Column 2, line 9, change "wide" to --side--.

Signed and Sealed this

*Eighteenth* Day of *March 1980*

[SEAL]

*Attest:*

SIDNEY A. DIAMOND

*Attesting Officer*

*Commissioner of Patents and Trademarks*